US009914324B2

(12) United States Patent
Bernstein et al.

(10) Patent No.: US 9,914,324 B2
(45) Date of Patent: Mar. 13, 2018

(54) KIT FOR SIMULATED STAINED GLASS ARTICLE, ARTICLE PRODUCED FROM THE KIT, AND SUBSTRATE FOR THE ARTICLE

(71) Applicant: Melissa & Doug, LLC, Wilton, CT (US)

(72) Inventors: Melissa Beth Bernstein, Westport, CT (US); Sofia E. Dumery, Brooklyn, NY (US); Ken Weiland, Brookfield, CT (US)

(73) Assignee: MELISSA & DOUG LLC, Wilton, CT (US)

( * ) Notice: Subject to any disclaimer, the term of this patent is extended or adjusted under 35 U.S.C. 154(b) by 21 days.

(21) Appl. No.: 15/215,181

(22) Filed: Jul. 20, 2016

(65) Prior Publication Data

US 2017/0028775 A1 Feb. 2, 2017

Related U.S. Application Data

(60) Provisional application No. 62/199,165, filed on Jul. 30, 2015.

(51) Int. Cl.
*B44F 1/00* (2006.01)
*B44F 1/06* (2006.01)

(52) U.S. Cl.
CPC ..... *B44F 1/063* (2013.01); *B44F 1/066* (2013.01)

(58) Field of Classification Search
CPC ..... Y10T 428/2462; Y10T 428/24479; B44F 1/063
USPC ..... 428/38
See application file for complete search history.

(56) References Cited

U.S. PATENT DOCUMENTS

| | | | |
|---|---|---|---|
| 3,322,074 | A | 5/1967 | Malnory |
| 3,444,034 | A | 5/1969 | Hewett |
| 3,533,889 | A | 10/1970 | Powell |
| 3,833,450 | A | 9/1974 | Powell |
| 3,923,357 | A | 12/1975 | Eckerle et al. |
| 4,140,828 | A | 2/1979 | Copping |
| 4,302,260 | A | 11/1981 | Meltzer |
| 4,335,170 | A | 6/1982 | Butler |
| 4,411,855 | A | 10/1983 | Fiebig, Jr. et al. |
| 4,438,165 | A | 3/1984 | Butler |
| 4,619,850 | A | 10/1986 | Charlton |
| 5,182,116 | A | 1/1993 | Ohaus |
| 6,183,678 | B1 | 2/2001 | Kusuma et al. |
| 6,250,027 | B1 | 6/2001 | Richards |

(Continued)

OTHER PUBLICATIONS

Melissa & Doug, "Stained Glass Made Easy—Ocean", catalog, 2014, Item #8582, 2 pages.

*Primary Examiner* — Alexander Thomas
(74) *Attorney, Agent, or Firm* — Wissing Miller LLP

(57) ABSTRACT

A kit for making a simulated stained glass article, having a light-transmissive molded plastic substrate with an array of ridges on one major surface, laterally defining a pattern of upwardly open spaces, and a set of light-transmissive molded plastic colored stickers that are respectively peripherally shaped to fit conformingly into the spaces of the pattern. Side walls of the ridges are beveled at an angle sufficient to enable release of the substrate from a mold but are steep enough to facilitate precise placement of the stickers in the spaces and to minimize transmission of light around the edges of the stickers. In an article made from the kit, the stickers and ridges simulate the glass pieces and lead cames of a conventional stained glass window.

17 Claims, 7 Drawing Sheets

(56) References Cited

U.S. PATENT DOCUMENTS

| | | | |
|---|---|---|---|
| 6,898,914 | B2 | 5/2005 | Folsom et al. |
| 2005/0116386 | A1 | 6/2005 | Hamano et al. |
| 2012/0231105 | A1 | 9/2012 | Palazzolo |

KIT FOR SIMULATED STAINED GLASS ARTICLE, ARTICLE PRODUCED FROM THE KIT, AND SUBSTRATE FOR THE ARTICLE

RELATED APPLICATION

The present application claims priority to U.S. Provisional Application No. 62/199,165, filed on Jul. 30, 2015, the disclosure of which is incorporated herein by reference in its entirety

BACKGROUND OF THE INVENTION

This invention relates to craft kits for assembling simulated stained glass articles constituted of light-transmissive plastic components, to the articles thus produced, and to molded plastic substrates for use in the kits and articles.

Non-limiting examples of these articles are decorative panels or plaques for hanging in windows or in openings of doors, so as to be transmissively illuminated by daylight; ornaments that can be hung in clear open air to turn or sway in a breeze, catching the sun's rays; and holiday ornaments, e.g., hung on Christmas trees in front of lights. When light shines through such a panel or ornament, an image formed by an arrangement of differently colored and shaped pieces of transparent or translucent plastic mounted side by side in the panel or ornament is brightly visible. Alternatively, the article may be effectively displayed simply as hung on a wall without being transmissively illuminated by any light source behind it.

Conventional stained glass windows, as known and used in religious edifices and other public buildings for many centuries, are typically more or less vertical planar assemblies of pieces of generally flat colored glass held together by cames, which are elongated strips or narrow frames of lead combined in an interconnected arrangement cooperatively defining the design of the stained glass window image or images and providing stable structural support for the colored glass elements of the window. Each of the cames may be H-shaped in cross-section, providing opposed grooves for respectively receiving edges of adjacent pieces of glass. Thus, each piece of glass is completely peripherally surrounded and held by cames in proximate relation to other similarly held pieces of glass. The different colors of glass used, the shapes of the individual pieces, and the positions in which they are held in the design by the cames, determine the content and appearance of the image they form. The cames themselves, being made of dark metal, are unobtrusive especially in contrast with the glow of daylight transmitted through the glass pieces; and, since the cames enclose the entire peripheries of the colored glass pieces, no haloes of white daylight are visible between the pieces and the cames. Consequently, the visual effect of the daylight-illuminated window is a glowing image made up of the colors of the constituent glass pieces. On inspection, the surfaces of the individual glass pieces may not be uniformly planar (especially in the case of older windows) and the cames both differ in surface texture from the glass and protrude slightly beyond the surfaces of the glass pieces they hold.

The creation of real stained glass windows is a highly sophisticated craft, requiring special skills and expertise in glassmaking, glass cutting and metalworking, and the products of this craft tend to be heavy, expensive and fragile. However, articles such as plaques or panels simulating the appearance of stained glass images can be desirable decorative accessories for the home and elsewhere. In addition, kits enabling persons with no relevant advanced skills or expertise to produce simulated stained glass works can have recreational and educational value. Plastics can serve as a medium for such production affording advantages of relatively low cost, low weight and low frangibility.

Accordingly, it has heretofore been proposed to provide systems (kits or methods) for producing simulated stained glass objects such as panels or ornaments, utilizing elements of plastic as components. One such system utilizes pieces of textured plastic to create elements of a pattern; a user places these pieces on a sheet of adhesive plastic to form a completed pattern, and deposits a plastic adhesive in the form of a bead overlapping adjacent pieces of textured plastic to simulate cames. Another system employs plastic panels with a design delineated by surface indentations in which a user, employing a brush, deposits coloring medium to simulate the appearance of stained glass. A further system has pieces of plastic, colored throughout their depth, which a user joins together with a plastic adhesive to form a simulation of stained glass. In a known kit, a flat plastic substrate has a pattern of spaces defined by black printed lines which are intended to simulate cames when self-sticking pieces of colored plastic are carefully positioned in the spaces; the effectiveness of the simulation, however, is limited by the two-dimensional nature of the came lines. In other respects as well, these known systems have drawbacks because the precise positioning of colored pieces on a flat sheet (even having flat guide lines) is difficult for young children and the use of fluent paint, adhesives or other materials can also be difficult as well as messy.

SUMMARY OF THE INVENTION

An object of the present invention is to provide a kit, for assembling a simulated stained glass article, that engages a user, is easy to use, and can safely be handled by users of all ages including young children. Another object is to provide a simulated stained glass article, easily and simply assembled from a kit, that attractively and effectively resembles products of conventional stained glass artistry. Yet another object is to provide an easily manufactured substrate for such a kit and article that facilitates assembly of the article and contributes to the effectiveness of the simulation.

To these and other ends, the invention in a first aspect contemplates the provision of a kit for producing a simulated stained glass article, including a light-transmissive molded plastic substrate having a flat base portion with opposed extended major surfaces and an array of interconnected ridges molded integrally with the base portion and projecting outwardly from one of the major surfaces thereof, the ridges having dark opaque outer ridge surfaces facing away from the base portion at a substantially common distance therefrom, the ridges and the aforesaid one major surface of the base portion cooperatively defining a pattern of outwardly open spaces laterally enclosed, shaped and separated from each other by ridges of the array, the ridges having side walls beveled at an angle, relative to a line normal to the aforesaid base portion major surface, sufficient to enable release of the substrate from a mold in which the substrate is formed; and a set of light-transmissive colored plastic stickers for mounting in the spaces of the pattern, the stickers of the set corresponding in number to the spaces of the pattern and corresponding in shape to the spaces such that the stickers of the set respectively fit conformingly into particular spaces of the pattern, each of the stickers having a light-transmissive adhesive coating for adhering the sticker to the base portion within the space in which it conformingly fits.

The term "light-transmissive" as used herein means translucent or transparent to visible light.

Conveniently or preferably, the kit also includes a release sheet to which the stickers are removably adhered before they are inserted in the spaces of the pattern on the substrate. In particularly advantageous embodiments, the stickers are adhered to the release sheet in a pattern of stickers in which each sticker has a position, relative to each other sticker of the set, corresponding to the position, in the pattern of spaces, of the particular one of the spaces into which it conformingly fits.

Also preferably, in at least many instances, the set of stickers includes stickers that differ in color from other stickers of the set. The aforesaid angle is advantageously in a range between about 3° and about 12° so that the ridge side wall is steep enough to facilitate precise placement of the stickers in the spaces and to minimize transmission of light through the substrate between the ridges and the stickers when the stickers are inserted in the spaces.

In a second aspect, the invention embraces simulated stained glass articles, e.g. for hanging in windows, door openings or outdoors to be transmissively illuminated by daylight, or for use as holiday ornaments or for hanging on walls, produced from the kits.

In a further aspect, the invention is directed to substrates included in the aforesaid kits and incorporated in the aforesaid articles. A currently preferred embodiment of the substrate of the invention is a substantially transparent molded plastic substrate with integrally formed caming ridges that create a pattern of closed, defined spaces and facilitate placement of conformingly shaped translucent colored stickers in the spaces, the caming ridges having side walls beveled at an angle sufficient to enable release of the substrate from a mold during formation but with a side wall slope that is steep enough to enable precise placement of the stickers in the spaces and to minimize the beveled appearance of the side walls and the transmission of light around the edges of the stickers when the stickers are placed in the spaces.

Further features and advantages of the invention will be apparent from the detailed description set forth below, together with the accompanying drawings.

DETAILED DESCRIPTION

Figure 1:
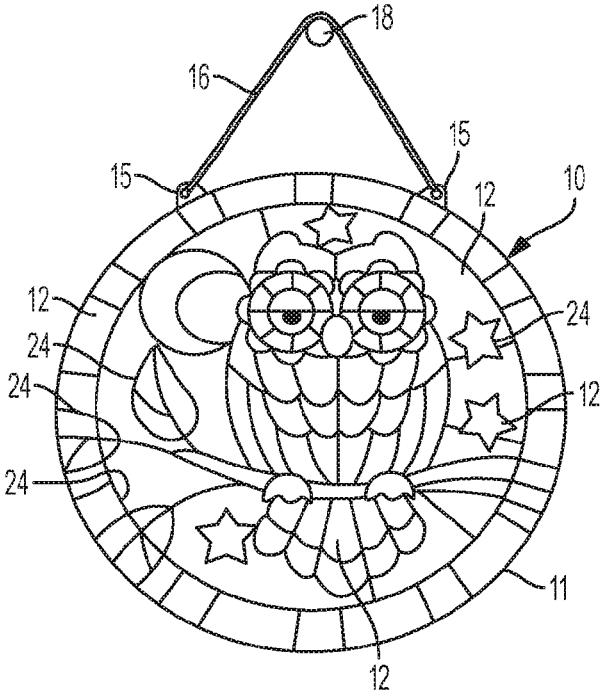
FIG. 1 is an elevational view of a simulated stained glass article embodying the present invention in a particular form.
Figure 2:
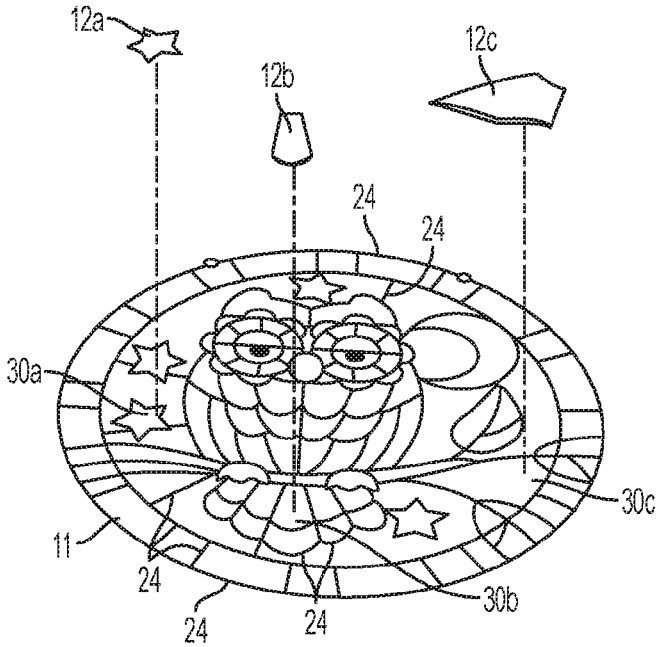
FIG. 2 is an exploded perspective view of the article of FIG. 1.

A simulated stained glass article 10 embodying the invention is illustrated in FIGS. 1-4. This article, configured as a flat disc with a circular periphery, includes a light-transmissive molded plastic substrate 11 on which are mounted a multiplicity of light-transmissive colored plastic stickers 12 arranged to form an image or picture, in this case an image of an owl sitting on a tree branch surrounded by the moon and stars. The substrate rim has, in its upper portion, a pair of integrally formed projecting eyelets 15 through which a cord 16 (hanging from a peg 18) is threaded for suspending the article 10 in a window (not shown) or door opening through which the article is transmissively illuminated. It will be understood that the eyelets 15, cord 16 and peg 18 are merely exemplary of ways in which the article 10 may be mounted for transmissive illumination by daylight or another light source. The article 10 may also be hung in the open outdoors, or used as a holiday ornament or wall hanging.

Just as a conventional stained glass window is illuminated by daylight passing through it so that a generally planar arrangement of different-colored pieces of glass each held peripherally by leaden cames is visible as a transmissively lighted, colored picture or design, the daylight-illuminated arrangement of colored stickers 12 in the article 10 is visible as a transmissively lighted, colored image of the owl, moon and stars. Typically stickers of different colors are used in different portions of the image—for instance, yellow stickers in areas representing the moon and stars, blue stickers in areas representing the sky, green stickers in areas representing leaves, etc.—and the appearance of the image is determined both by the colors selected, and by the positions and peripheral shapes of the stickers mounted on the substrate.

More particularly, the substrate 11 (FIGS. 3A-4) is a unitary, flat, substantially colorless, light-transmissive panel of molded plastic, preferably made by injection molding. A currently preferred plastic for the substrate is acrylonitrile butadiene styrene (ABS). The substrate has a substantially rigid base portion 20 with opposed, generally parallel planar extended surfaces 21 and 22, and an array of interconnected ridges 24, herein termed caming ridges because they resemble and are somewhat similar in function to the lead cames of conventional stained glass. Although distinctively shaded (for purposes of illustration) in the schematic cross-sectional view of FIG. 3D, the caming ridges 24 are actually molded integrally with the base portion 20 (as is shown in FIG. 4) and project outwardly from the base portion major surface 21 for substantially a common distance; the outer surface 26 of each of the ridges has a dark opaque (e.g. black) coating 28 formed as by printing with black ink after the substrate is molded. In an example of dimensions of the substrate, the base portion is about 3 mm thick, the ridges 24 project about 1 mm (or slightly more) above the surface 21, and the ridge outer surfaces 26 are about 2 mm wide.

The caming ridges 24 and the base portion major surface 21 cooperatively define a pattern of outwardly open spaces 30 that are laterally shaped, enclosed and separated from each other by ridges of the array. The side walls 32 of the ridges are beveled at an angle α (FIG. 4) to a line P normal to the base portion major surface 21; this angle is made sufficient to enable release of the substrate from a mold during formation yet still provides ridge side walls with a slope steep enough to facilitate precise placement of the stickers 12 in the spaces 30 and to minimize transmission of light (through clear colorless plastic of the substrate 11) around the edges of the stickers when the stickers are placed in the spaces. A currently preferred or optimum value of the angle α is 5°; more broadly, the angle α may be chosen within a range from about 3° to about 12°. Although an angle α of 5° or less presents difficulties in separation from an ordinary mold, an angle α of about 3° or more is satisfactory to enable such release using a system having ejector pins to push the molded panel out of the mold without showing numerous injection points on the panel, as is known in the plastic injection molding art. Transmitted light around the sticker edges does not detract excessively from the simulation of stained glass appearance at values of α up to about 12°, or even somewhat higher.

The multiplicity of light-transmissive stickers 12 included in the article 10 constitutes a set of such stickers for mounting in the spaces 30 of the aforementioned pattern. The stickers of the set correspond in number to the spaces of the pattern and respectively correspond in peripheral shape to the spaces such that each of the stickers fits conformingly into a particular one of the spaces; for instance, as indicated in the exploded view of FIG. 2, sticker 12*a* fits into space 30*a*, sticker 12*b* fits into space 30*b* and sticker 12*c* fits into space 30*c*.

Figure 3A:
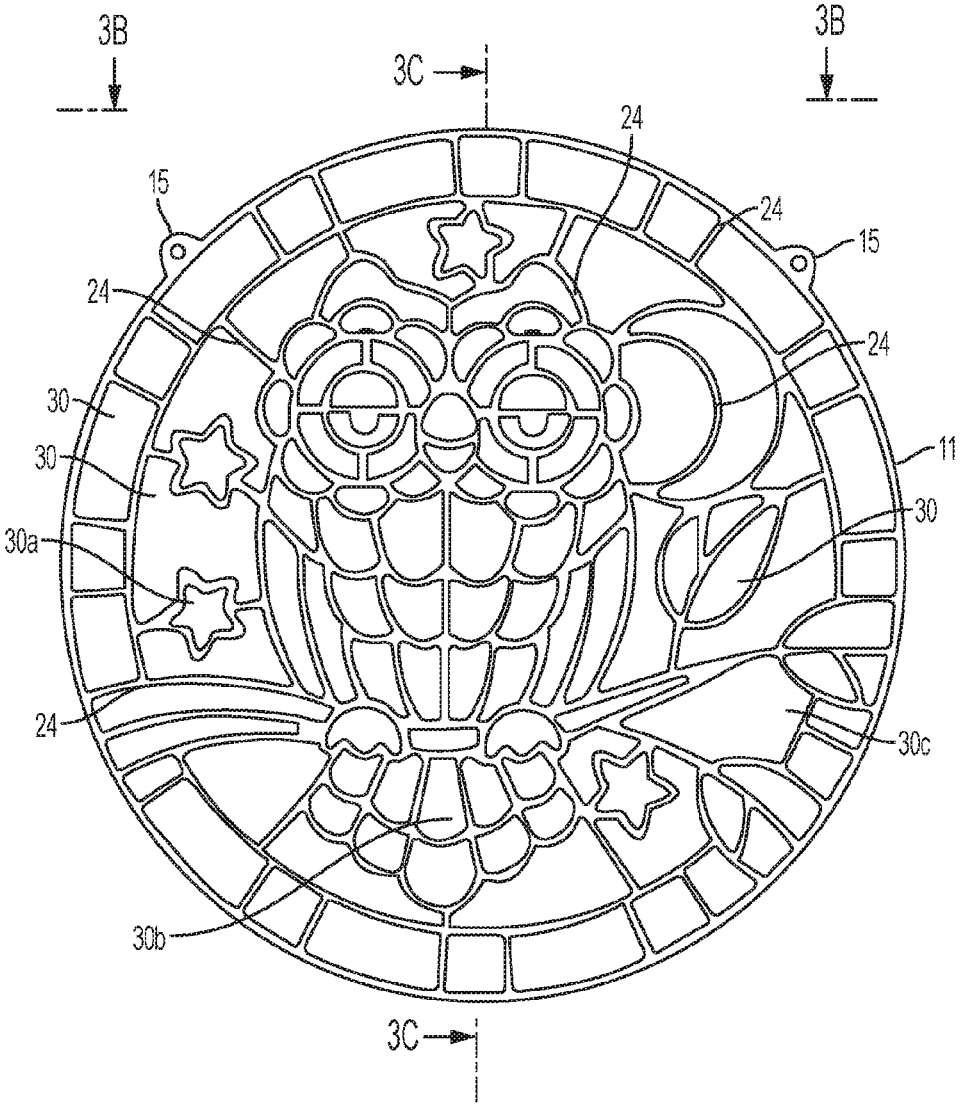
FIG. 3A is an enlarged elevational view of the substrate of the article of FIG. 1.
Figure 3B:
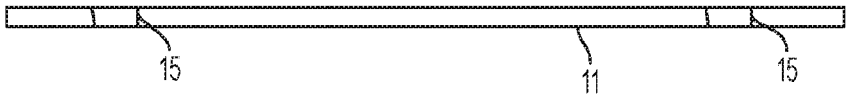
FIG. 3B is a side edge view of the substrate taken along the line 3B-3B of FIG. 3A.
Figure 3C:
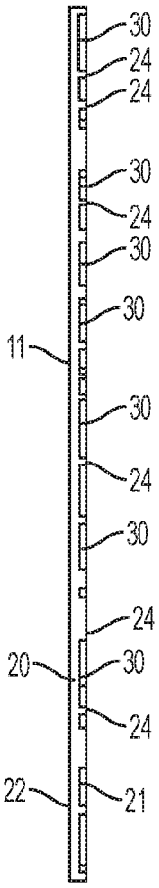
FIG. 3C is a sectional view of the substrate taken along the line 3C-3C of FIG. 3A.
Figure 3D:
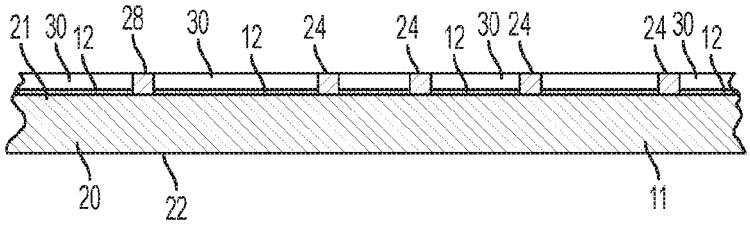
FIG. 3D is a further enlarged fragmentary schematic sectional view of the substrate of FIG. 3A, with the stickers also schematically represented.
Figure 4:
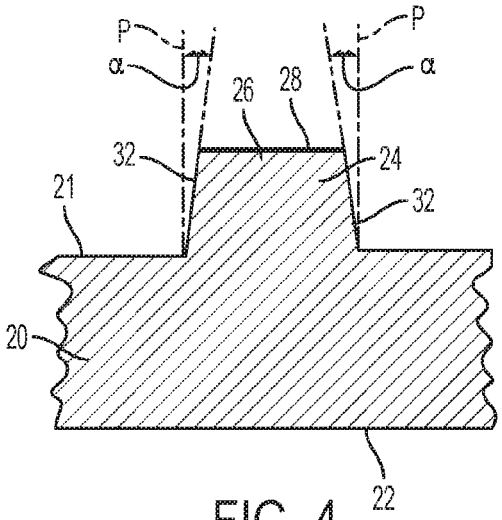
FIG. 4 is a still further enlarged fragmentary cross-sectional view of a portion of the substrate of FIG. 3A including one of the ridges therein.
Figure 5:
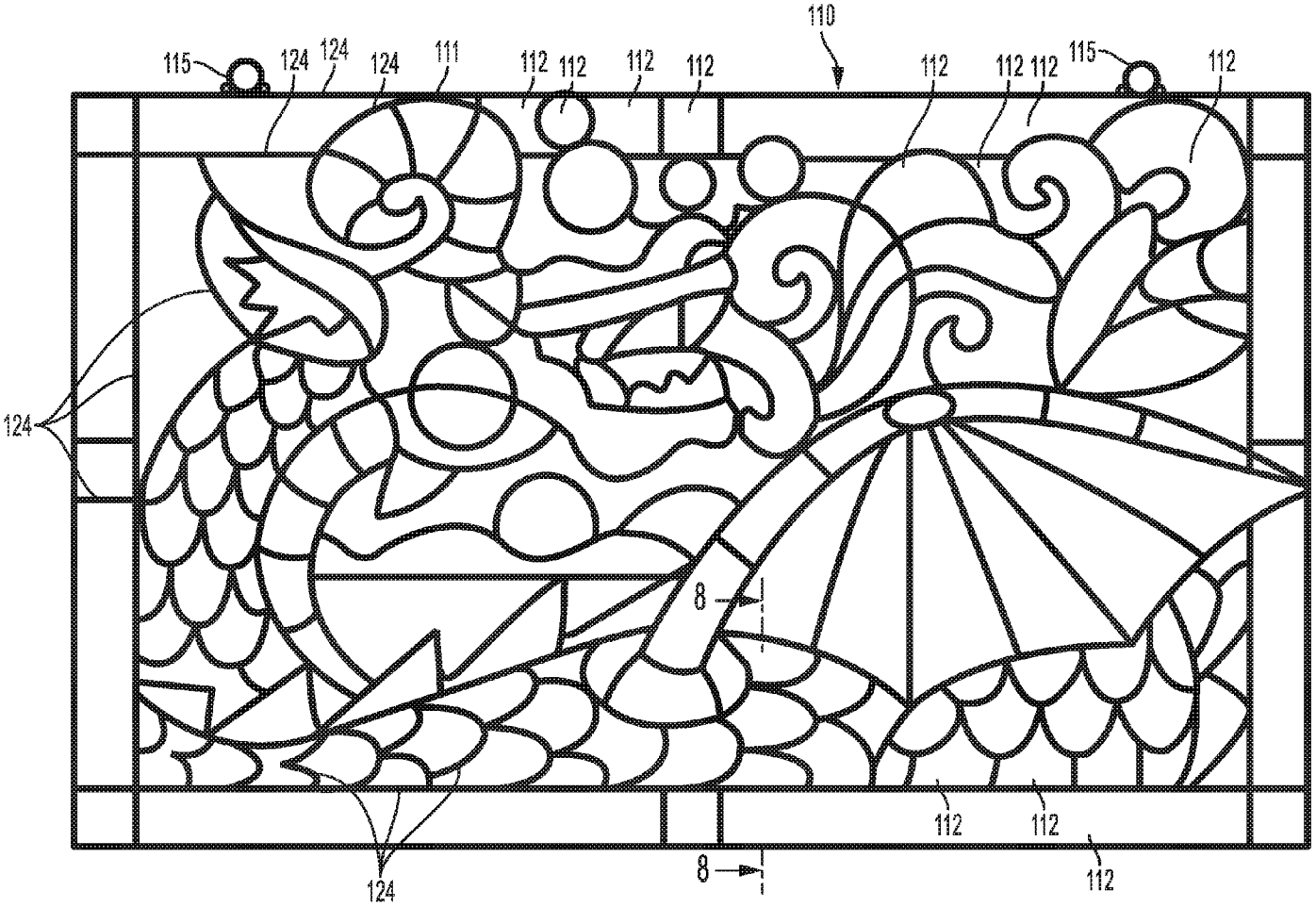
FIG. 5 is an elevational view of another simulated stained glass article embodying the invention.

The stickers 12 in the spaces 30 are represented in the schematic view of FIG. 3D as thin planar elements. Actually, each of the stickers is a molded plastic (e.g. polyvinyl chloride) body of appreciable thickness relative to the depth of the spaces 30 (height of the ridges 24), though preferably not as thick as the ridges are high. Each sticker 12 has a planar inner surface (facing the base portion surface 21, when the sticker is mounted on the substrate) bearing a light-transmissive "self-sticking" (e.g. pressure-sensitive) adhesive for adhering the sticker to the area of surface 21 that constitutes the floor of the space 30 in which the sticker conformingly fits. The outer surfaces of at least some of the stickers may have a molded relief configuration such as a concavity, or plural indentations, enhancing the resemblance of the stickers to pieces of conventional stained glass.

Owing to the conforming peripheries of each sticker 12 and the particular space 30 into which it fits, when the sticker is mounted in the space its outer edge snugly abuts the beveled side walls of the ridges 24 defining the space. The ridges facilitate highly accurate placement of the stickers on the substrate, serving as positive guides so as to minimize the degree of manipulative skill and care required to position the stickers properly and optimize the simulation of stained glass and cames by the stickers and caming ridges. The aforementioned steep slope of the ridge side walls resulting from selection of angle α between 3° and 12° enables such precise placement of the stickers and minimizes both the beveled appearance of the ridge side walls and the transmission of light through clear plastic of the substrate base and ridges around the stickers, which would detract from the stained glass appearance of the article 10.

Another simulated stained glass article 110 embodying the invention, and a kit (also embodying the invention) for assembling the article 110, are illustrated in FIGS. 5-10. The article 110 includes a flat, substantially rigid, unitary injection molded colorless light-transmissive substrate panel 111 of rectangular configuration, and a set of molded light-transmissive colored plastic stickers 112. A pair of eyelets 115 are molded on the top rim of the panel 111 for receiving a cord (not shown in FIG. 5) to hang the article in a window or door opening (also not shown) for transmissive illumination by daylight, or for hanging outdoors, or as a holiday ornament, or on a wall where it is not transmissively illuminated by a light source.

The panel 111 has a base portion 120 with opposed, generally parallel extended major surfaces 121 and 122 and an array of interconnected caming ridges 124 molded integrally with the base portion and projecting outwardly from surface 121 thereof. The caming ridges have outer ridge surfaces 126, facing away from surface 121 at a substantially constant distance therefrom; ridge surfaces 126 are printed or otherwise provided with a dark opaque (e.g. black ink) coating 128 to simulate the dark appearance of leaden cames in a conventional stained glass window. These ridges, together with the base portion surface 121, cooperatively define a pattern of outwardly open spaces 130 peripherally shaped, and separated laterally from each other by, ridges of the array. Each space 130 has an area of surface 121 as a floor. As in the embodiment of FIGS. 1-4, the substrate may be molded of ABS plastic, with an overall thickness (between surface 122 and the outer ridge surfaces 126) of 4 mm and an outer ridge surface width of about 2 mm.

The side walls 132 of the ridges 124 are beveled in the same manner as the side walls 32 of ridges 24 shown in FIG. 4, at an angle α to a line P normal to the base portion major surface (21 in FIG. 4; 121 in FIGS. 5-10) in a range from about 3° to about 12°, which is sufficient to enable release of the substrate from a mold during formation, yet still provides the ridge side walls with a slope steep enough to facilitate precise placement of the stickers 112 in the spaces 130 and to minimize transmission of light (through clear colorless plastic of the substrate panel 111) around the edges of the stickers when the stickers are placed in the spaces.

The stickers 112 of the set correspond in number to the spaces 130 of the aforesaid pattern, and respectively correspond in peripheral shape and dimensions to individual ones of the spaces, so that each sticker fits closely and conformingly into one particular space 130; i.e., for each sticker in the set there is one space in the pattern into which that sticker conformingly fits, and for each space there is one sticker that conformingly fits into it.

As in the embodiment of FIGS. 1-4, the stickers of the set are molded plastic elements (conveniently or preferably made of polyvinyl chloride) having a thickness which is appreciable though preferably somewhat less than the height of the ridges 124 above the base portion surface 121. The upper surfaces of at least some of the stickers (facing away from the substrate) may be molded with a relief configuration or pattern as indicated at 140 in FIG. 8, while their lower surfaces (facing toward the substrate) are planar as are the areas of surface 121 constituting the floors of spaces 130. A light-transmissive layer or coating 142 of self-sticking adhesive (e.g., pressure sensitive adhesive) is provided on the lower surfaces of the stickers, so that when the stickers 112 are pressed into the spaces 30 in which they respectively conformingly fit, they will adhere securely and permanently to the substrate.

Typically, two or more different colors of stickers are included in the set. When the stickers have been mounted on the substrate in their respective spaces 130, they cooperatively constitute an image, visible in transmitted light, such as a representation of a natural or architectural object, a symbol, or a design. In the article 110 of FIG. 5, the image depicts a dragon. The appearance of the image is determined by the shapes, colors, sizes and relative positions of the stickers that make it up. Simulation of actual stained glass windows is enhanced by the three-dimensional character of the structure of caming ridges and stickers, and by the accuracy with which the stickers are positioned owing to the effect of the caming ridges in guiding their precise placement as they are manually inserted in the spaces. Individual stickers need not be uniformly monochromatic but may exhibit swirls, streaks and variations in color density across their surfaces, imparted in known manner to the plastic of which they are composed, at the time of molding.

Figure 6:
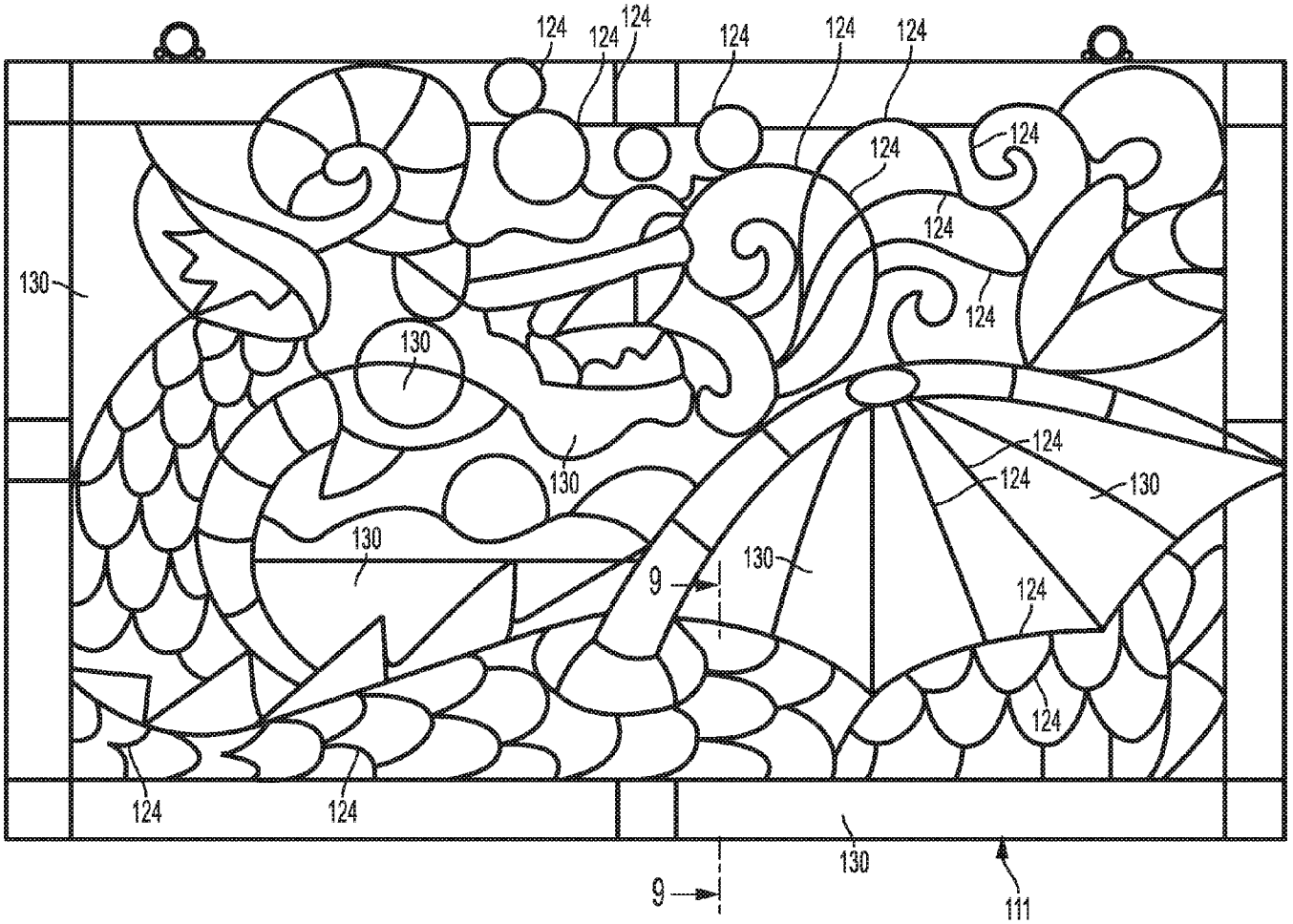
FIG. 6 is a view similar to FIG. 5 of a substrate of the invention included in an embodiment of the kit of the invention from which the article of FIG. 5 is made.
Figure 7:
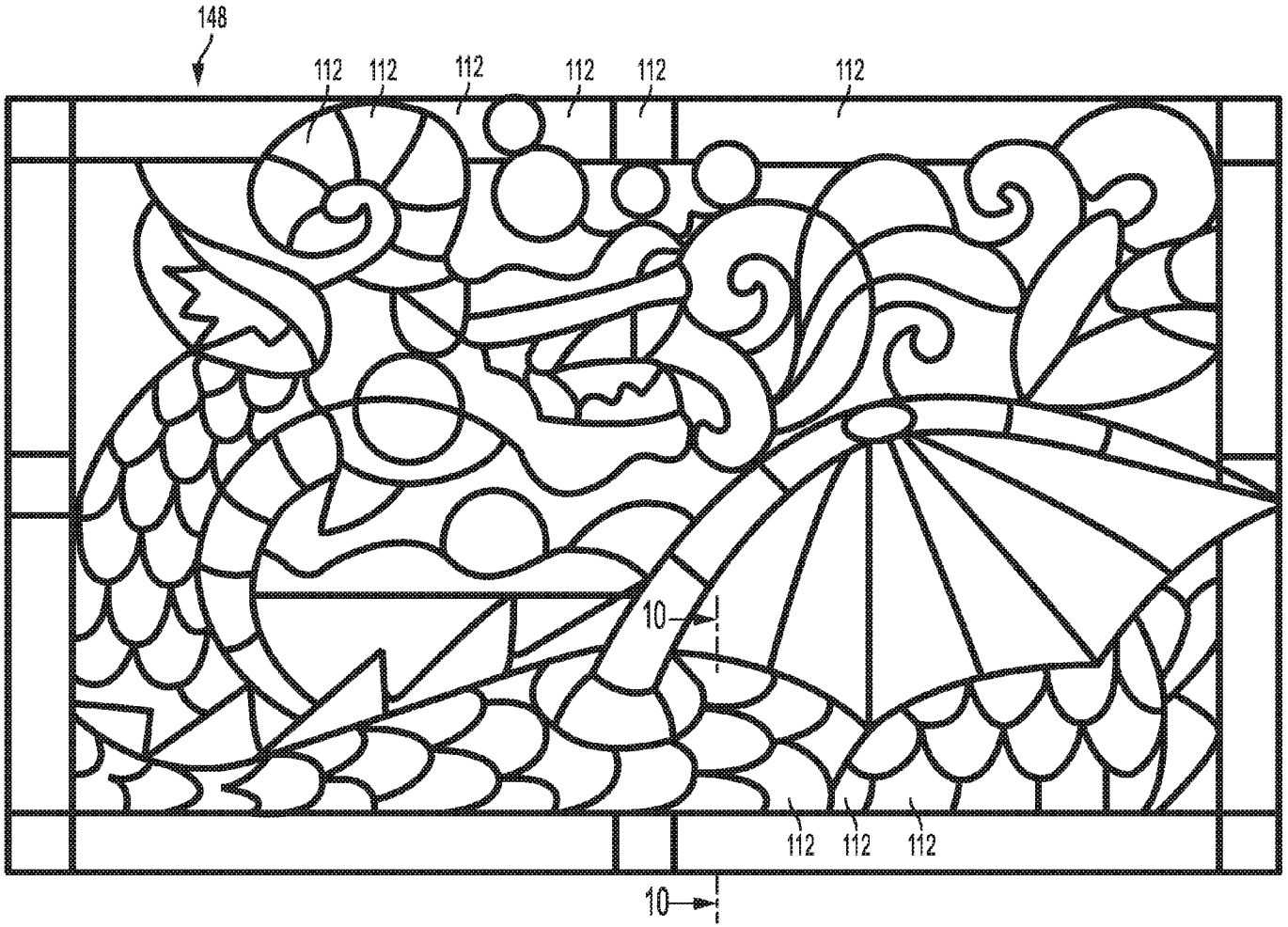
FIG. 7 is a view similar to FIG. 5 of a release sheet bearing a set of stickers included in the same embodiment of the kit of the invention.
Figure 8:
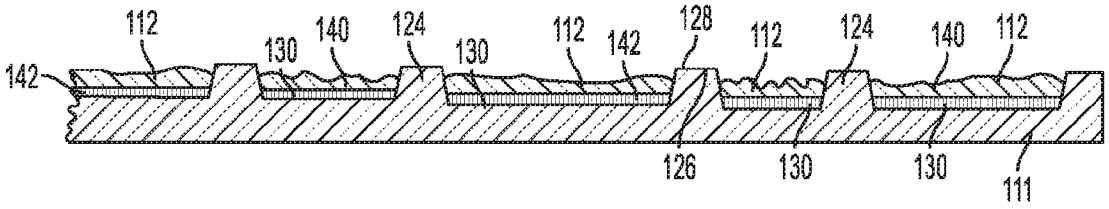
FIG. 8 is an enlarged fragmentary sectional view along line 8-8 of FIG. 5.
Figure 9:
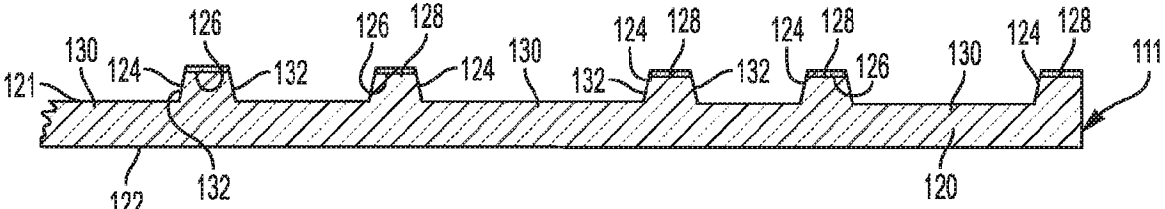
FIG. 9 is an enlarged fragmentary sectional view along line 9-9 of FIG. 6.
Figure 10:
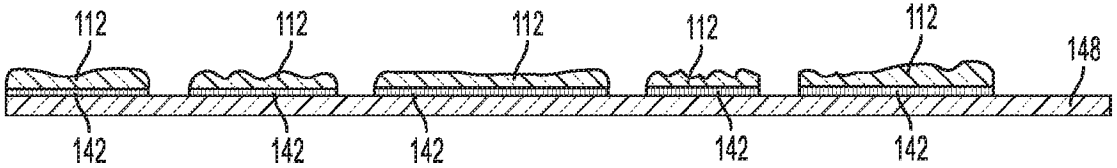
FIG. 10 is an enlarged fragmentary sectional view along line 10-10 of FIG. 7.

The elements of the kit for assembling the article 110 are shown in FIGS. 6, 7, 9 and 10. The substrate panel 111, as molded, having the outer ridge surfaces printed or coated darkly opaque, is illustrated in FIGS. 6 and 9, with its pattern of ridge-defined spaces 130 extending over its surface 121 and ready to receive the stickers.

The set of stickers 112 is removably mounted on an extended surface of a plastic release sheet 148 with the adhesive-bearing lower surfaces of the stickers facing and releasably adhered to sheet 148. To facilitate removal from the sheet, they are distributed over the sheet in spaced-apart relation to each other. While their distribution on the sheet surface may be random, it is preferred, in at least many instances, that the stickers be adhered to the release sheet in a pattern of stickers wherein each sticker has a position, relative to each other sticker of the set, corresponding to the position, in the pattern of spaces 130, of the particular space into which that sticker conforming fits. Thus a user, assembling the article 110 from the kit, having the substrate 110 and the sticker-bearing sheet 148 side by side, can immediately see which sticker is to be mounted in which space on the substrate, and can manually peel each sticker in succession from the release sheet and press it into the correspondingly located space on the substrate.

If it is desired to have a simulated stained glass article in which the simulation of stained glass appearance is equally effective from both sides of the article, the substrate may include a second array of interconnected caming ridges, molded integrally with the base portion and projecting outwardly from the other major surface thereof, such other major surface and the ridges of the second array cooperatively defining a second pattern of outwardly open spaces laterally shaped, enclosed and separated from each other by ridges of the second array, wherein the second pattern of outwardly open spaces and the first-mentioned pattern of outwardly open spaces are in register as viewed through the base portion of the substrate; and wherein the kit further includes a second set of light-transmissive colored plastic stickers which is a mirror-image duplicate of the first-mentioned set of stickers, for mounting in the outwardly open spaces of the second pattern.

It is to be understood that the invention is not limited to the features and embodiments hereinabove specifically set forth, but may be carried out in other ways without departure from its spirit.

What is claimed is:

1. A kit for producing a simulated stained glass article, comprising:

(a) a light-transmissive molded plastic substrate having (i) a flat base portion with opposed extended major surfaces and (ii) an array of interconnected caming ridges molded integrally with the base portion and projecting outwardly from one major surface thereof, the ridges having dark opaque outer ridge surfaces facing away from the base portion at a substantially common distance therefrom, and said one major surface and said ridges cooperatively defining a pattern of outwardly open spaces laterally shaped, enclosed and separated from each other by ridges of the array, each of said spaces having an area of said one major surface as a floor, the ridges having side walls beveled at an angle, relative to a line normal to said one major surface, sufficient to enable release of the substrate from a mold in which said substrate is formed while providing a ridge side wall slope steep enough to enable precise placement of the stickers in the spaces and to minimize the beveled appearance of the side walls and the transmission of light around edges of the stickers when the stickers are placed in the spaces; and (b) a set of light-transmissive colored plastic stickers for mounting in the spaces of said pattern, the stickers of said set corresponding in number to the spaces of said pattern and respectively corresponding in peripheral shape and dimensions to said spaces such that each of said stickers conformingly fits into a particular one of said spaces, each of said stickers having a light-transmissive self-sticking adhesive coating for affixing the sticker to the floor of the space into which it conformingly fits as aforesaid.

2. A kit as defined in claim 1, further including a release sheet having an extended surface to which said stickers are removably adhered.

3. A kit as defined in claim 2, wherein said stickers are adhered to said release sheet in a pattern of stickers wherein every individual sticker has a position, relative to each other sticker, corresponding to the position, in the pattern of spaces, of the particular one of said spaces into which said individual sticker conformingly fits.

4. A kit as defined in claim 1, wherein said substrate is a substantially colorless panel.

5. A kit as defined in claim 1, wherein said substrate is a substantially rigid panel.

6. A kit as defined in claim 1, wherein said angle is between about 3° and about 12° to a line perpendicular to said one major surface.

7. A kit as defined in claim 6, wherein said angle is about 5° to a line perpendicular to said one major surface.

8. A kit as defined in claim 1, wherein the substrate is a substantially flat, substantially colorless and substantially rigid panel molded of acrylonitrile butadiene styrene, and wherein the major surfaces of the base portion thereof are substantially planar.

9. A kit as defined in claim 1, wherein some of the stickers of the set differ in color from other stickers of the set.

10. A kit as defined in claim 9, wherein the stickers of the set are molded elements each having an upper surface and a lower surface respectively facing away from and toward the substrate when the stickers are disposed in the spaces, the lower surfaces of the stickers are planar and bear a layer or coating of said adhesive, said adhesive being a pressure-sensitive adhesive, and at least some of the stickers having an upper surface bearing a relief configuration formed during molding of the stickers.

11. A simulated stained glass article, comprising (a) a light-transmissive molded plastic substrate having (i) a base portion with opposed extended major surfaces and (ii) an array of interconnected caming ridges molded integrally with the base portion and projecting outwardly from one major surface thereof, the ridges having dark opaque outer ridge surfaces facing away from the base portion at a substantially common distance therefrom, and said one major surface and said ridges cooperatively defining a pattern of outwardly open spaces laterally shaped, enclosed and separated from each other by ridges of the array, the ridges having side walls beveled at an angle, relative to a line normal to said one major surface, sufficient to enable release of the substrate from a mold in which said substrate is formed while providing a ridge side wall slope steep enough to enable precise placement of the stickers in the spaces and to minimize the transmission of light around edges of the stickers when the stickers are placed in the spaces; and (b) a set of light-transmissive colored plastic stickers mounted in the spaces of said pattern, the stickers of said set corresponding in number to the spaces of said pattern and each sticker corresponding in peripheral shape and dimensions to the particular space in which it is mounted such that it conformingly fits into said particular space, each of said stickers being adhered to the substrate by a light-transmissive self-sticking adhesive.

12. An article as defined in claim 11, wherein said base portion is substantially flat.

13. An article as defined in claim 11, wherein said base portion is substantially transparent.

14. An article as defined in claim 11, wherein said adhesive is a pressure-sensitive adhesive.

15. An article as defined in claim 11, wherein said set of stickers includes stickers that differ in color from others of said set.

16. An article as defined in claim 11, wherein said angle is between about 3° and about 12° to a line perpendicular to said one major surface.

17. An article as defined in claim 16, wherein said angle is about 5° to a line perpendicular to said one major surface.

* * * * *